US005484569A

United States Patent [19]

Klein et al.

[11] Patent Number: 5,484,569

[45] Date of Patent: Jan. 16, 1996

[54] SILVER PALLADIUM ALLOY

[75] Inventors: Arthur S. Klein, Orange; Edward F. Smith, III, Madison, both of Conn.

[73] Assignee: The J. M. Ney Company, Bloomfield, Conn.

[21] Appl. No.: 289,509

[22] Filed: Aug. 12, 1994

[51] Int. Cl.[6] ..... C22C 5/06; C22C 5/08; C22C 30/00

[52] U.S. Cl. ..... 420/503; 420/587; 148/430; 148/442

[58] Field of Search ..... 420/503, 587; 148/430, 442, 405, 419

[56] References Cited

U.S. PATENT DOCUMENTS

| | | | |
|---|---|---|---|
| 1,935,897 | 11/1933 | Wise . | |
| 2,138,599 | 11/1938 | Gwyn . | |
| 2,222,544 | 12/1940 | Spanner et al. . | |
| 4,350,526 | 9/1982 | Schaffer . | |
| 4,980,245 | 12/1990 | Marino | 428/671 |
| 5,000,779 | 3/1991 | German et al. . | |

FOREIGN PATENT DOCUMENTS

| | | | |
|---|---|---|---|
| 52-047516 | 4/1977 | Japan | 420/587 |
| 59-107047 | 6/1984 | Japan | 420/587 |
| 59-107048 | 6/1984 | Japan | 420/587 |
| 59-113151 | 6/1984 | Japan | 420/587 |
| 59-113144 | 6/1984 | Japan | 420/587 |
| 59-182932 | 10/1984 | Japan | 420/587 |
| 59-179740 | 10/1984 | Japan | 420/587 |
| 60-056049 | 4/1985 | Japan | 420/587 |

*Primary Examiner*—David A. Simmons
*Assistant Examiner*—Margery S. Phipps
*Attorney, Agent, or Firm*—Pepe & Hazard

[57] ABSTRACT

A silver/palladium alloy for electronic applications comprises, on a percent by weight basis, 35–60 silver, 20–44 palladium, 5–20 copper, 1–7 nickel, 0.1–5 zinc, to 0.18 boron, up to 0.05 rhenium and up to 1 percent by weight of modifying elements selected from the group consisting of ruthenium, zirconium and platinum. This alloy exhibits high oxidation and tarnish resistance and is formed into wrought electronic components such as contacts and brushes to provide low noise.

13 Claims, No Drawings

SILVER PALLADIUM ALLOY

BACKGROUND OF THE INVENTION

The present invention relates to precious metal alloys, and, more particularly, to such alloys which are especially adapted for electronic applications.

As is well known, precious metal alloys have been favored for a number of electronic applications where low contact resistance and/or noise is desired over extended periods of time. This is particularly true when the electronic products incorporating such elements may be exposed to relatively high temperatures, high humidity, sulfurous or other corrosive atmospheres, etc. Alloys with high gold and platinum contents were early favored for such applications, but the cost of such alloys became prohibitive for many applications and militated against more widespread use. This brought about efforts to develop alloys based upon less costly metals. As a result, palladium alloys became widely utilized in an effort to provide such desirable properties as corrosion and tarnish resistance at a lower cost. However, palladium alloys are also relatively expensive, and this cost has militated against still wider use.

It is an object of the present invention to provide a novel silver/palladium alloy which exhibits a high degree of resistance to oxidation and tarnish and provides good electrical properties.

It is also an object to provide such an alloy which is relatively low in cost in comparison to alloys having higher contents of noble metals.

Another object is to provide electronic components fabricated from such alloys and which exhibit desirable resistance to oxidation and tarnish as well as controlled flexibility for contact applications.

SUMMARY OF THE INVENTION

It has now been found that the foregoing and related objects may be readily attained in a silver/palladium alloy for electronic applications which comprises, on a percent by weight basis, 35–60 silver, 20–44 palladium, 5–20 copper, 1–7 nickel, 0.1–5 zinc, up to 0.18 boron, up to 0.05 rhenium, and up to 1 of modifying elements selected from the group consisting of ruthenium, zirconium and platinum. This alloy exhibits high oxidation and tarnish resistance.

Preferably, silver comprises 45–50 percent by weight and palladium comprises 30–35 percent by weight. Copper comprises 12–16 percent by weight, and nickel comprises 4–6 percent by weight.

Desirably, the alloy contains 0.06–0.12 percent by weight boron, and 0.02–0.1 percent by weight rhenium. The alloy is formed into wrought metal electronic components which exhibit contact resistance of less than 50 milliohms after 1000 hours exposure to air at 150° C., and less than 250 milliohms after 30 days exposure to a humid sulfurous atmosphere at 50° C. Moreover, the component exhibits a modulus of at least $15\times10^6$ p.s.i..

DETAILED DESCRIPTION OF THE PREFERRED EMBODIMENTS

As indicated hereinbefore, the combination of silver with palladium provides most of the present alloy and, in combination with other components, is found to provide an alloy which exhibits excellent resistance to oxidation and tarnish despite the high silver content. Moreover, by proper combination of the elements described hereinafter in detail, the alloy exhibits good processing characteristics and mechanical strength together with a desirable modulus to provide the desired flexibility for moving contact applications.

The alloys of the present invention essentially contain palladium, silver, copper, nickel and zinc, and desirably contain small amounts of boron and rhenium. They may also contain small amounts of modifiers selected from the group of ruthenium, zirconium and platinum.

Turning first to the silver content, it may range from as little as 35 percent to as much as 60 percent, and is preferably in the range of 45–50 percent. As will be appreciated, the silver is the major matrix element, and it provides good oxidation resistance although providing poor tarnish resistance and is relatively soft providing a low modulus.

Palladium is provided in the range of 20–44 percent, and preferably in the range of about 30–35 percent. In this combination, the palladium provides the desired tarnish resistance and reacts with the copper component to provide a basis for the age hardening reaction to provide physical properties of desirable characteristics. Moreover, it also increases the modulus.

Copper is the next largest component of the alloy and is provided in the range of 5–20 percent, and preferably 12–16 percent. It participates in the age hardening reaction of the alloy and increases the modulus of the alloy, but, as would be expected, it would undesirably affect tarnish and oxidation resistance if used in larger amounts.

Nickel is provided in the range of 0.1–7 percent, and preferably 4–6 percent. It provides a major increase in the modulus of the resultant alloy, but it would undesirably affect oxidation resistance if larger amounts were employed.

Zinc is provided in the range of 0.1–5 percent, and preferably 0.5–1.5 percent. It has been found to participate with nickel in providing tarnish and oxidation resistance, and it also participates in the second phase reaction which the alloy undergoes. Lastly, it also serves as a deoxidant for the alloy during the initial casting into ingots.

Boron is an optional but desirable component within the range of 0–0.18 percent, and preferably 0.06–0.12 percent. The boron is believed to participate in hardening and providing other desirable physical properties and also improves tarnish resistance.

Rhenium is a desirable component in an amount from a trace to 0.5 percent and preferably in the range of 0.02–0.1 percent. Rhenium is a grain refiner for this alloy and contributes to providing the desired modulus for the alloy.

Small amounts of ruthenium, zirconium and platinum in the range of 0–1 percent total for these modifying elements do contribute some improvement in properties. Platinum provides nobility and ruthenium appears to act as a grain refiner in this alloy. Zirconium contributes to oxidation resistance and physical properties.

A highly desirable commercial alloy of the present invention has the following composition:

| Element | Percent by Weight |
|---|---|
| Silver | 47.64 |
| Palladium | 32.23 |
| Copper | 14 |
| Nickel | 5 |
| Zinc | 1 |
| Boron | 0.08 |
| Rhenium | 0.05 |

This alloy is rolled into sheet which can be utilized to fabricate various electronic products including brushes and contacts. Other applications are commutators, potentiometers and slip rings. The material can be drawn or otherwise formed into various types of electronic components because of its physical properties.

The alloy exhibits excellent resistance to tarnish in a humid sulfurous atmosphere using ASTM Test B 809-90, and excellent oxidation resistance as measured by prolonged exposure to an oxygen containing atmosphere at a temperature of 150° C. Contact resistance is generally measured using ASTM Standard B 539-90 (Method C), and the probes are fabricated in accordance with the procedure of ASTM Standard B 667-80. Generally, the alloys of the present invention all exhibit contact resistance of less than 50 milliohms after prolonged exposure of 1000 hours at the elevated temperature of 150° C. to an air atmosphere and resistance of less than 250 milliohms after 30 days exposure to a sulfurous atmosphere at 50° C. Moreover, the alloys of the present invention exhibit an elastic modulus of at least $15\times10^6$ p.s.i. making them suitable for a number of applications where flexibility is desired. Hardness for the alloys of the present invention as heat treated at 810° F. for 45 minutes is greater than 250 Knoop with a 100 gram load.

For example, in a cantilever contact, most current designs use either palladium or copper based alloys with a modulus in the range of 16–17. In a cantilever style contact, the resultant spring rate of the contact is a linear function of the modulus. Therefore, a modulus of less than 15 would require either a thicker contact or a larger deflection to reach the same gram force, and this is undesirable since space is generally at a premium in electronic equipment.

The contact resistance measurements utilized in the test in the present application utilize a hemispherical gold alloy probe with the normal load set at 31 grams. The alloy is sold by The J. M. Ney Company under the designation NEYORO G and has a nominal composition of 71.5 Au, 4.5 Ag, 8.5 Pt, 14.59 Cu, 0.9 Zn, and 0.01 Ir. An open circuit voltage of 20 millivolts is used to prevent electrical breakdown of any surface film. In the resistance test, each sample is measured in five different locations at its surface and the data contained is the average of those readings. In all cases, the zero time (pre-exposure) contact resistance was found to be below 10 milliohms.

Hardnesses are reported in Knoop values and are measured using a 100 gram load.

Processability is another significant property since the cast bar stock must be rolled into relatively thin strip or sheet. Accordingly, an alloy which evidences cracking at less than a 50 percent reduction is generally considered to have poor processing characteristics. The alloy can be used as wrought, and may or may not be heat treated depending upon the intended application.

Illustrative of the variations in properties which are achieved by modifications of the composition both within and without the ranges defined above are the data set forth in the following table:

| | Composition | | | | | | | | | | | | | | Hardness |
|---|---|---|---|---|---|---|---|---|---|---|---|---|---|---|---|
| | | | | | | B | | | Mod- | Contact resistance (milli ohms) | | | | | ht unless |
| | | | | | | put | | | ulus | 150 C. Oxidation | | Sulfide Tarnish | | Pro- | marked |
| Alloy | Ag | Pd | Cu | Zn | Ni | up | recovery | Other | $10^6$ psi | 1000 hr | 2000 hr | 10 days | 30 days | cess | as CW |
| Paliney 6 | 38 | 44 | 16 | | 1 | | | 1-Pt | 16 | 7 | 10 | 30 | 50 | ok | 320–380 ht |
| 76 | 59 | 25 | 14 | 2 | | | | | 14 | 9 | 13 | 27 | 82 | ok | |
| 77 | 58 | 25 | 14 | 2 | 1 | | | | 15 | | 10 | 26 | 21 | ok | 255 |
| 80 | 58 | 25 | 14 | 2 | | | | 1-Sn | 15 | | | 655 | | ok | |
| 86 | 48 | 32 | 14 | 1 | 5 | | | | 15 | 15 (700 hr) | | 200 | | ok | |
| 87 | 47.9 | 32 | 14 | 1 | 5 | 0.1 | 0.03 | | 15 | 8 | 10 | 150 | 600 | ok | 300 |
| 91 | 43 | 32 | 14 | 1 | 10 | | | | 14 | 12 (700 hr) | | 5000 | | ok | |
| 92 | 42.9 | 32 | 14 | 1 | 10 | 0.1 | | | 14 | 10 | | 944 | | ok | |
| 94 | 41.9 | 32 | 14 | 1 | 10 | 0.1 | | 1-Co | 14 | | | 890 | | ok | |
| 96 | 47.6 | 32 | 14 | 1 | | | | 5-Co | 15 | | | 761 | | ok | |
| 98 | 58.9 | 27 | 14 | | | 0.1 | | | 15 | 9 | | 244 | | ok | |
| 99 | 49 | 32 | 14 | | 5 | | | | 14 | | | 1000 | | ok | |
| 103 | 51.3 | 22.5 | 14 | 1 | 10 | 0.2 | | | 13 | | | 1854 | | ok | |
| 116 | 46.9 | 32 | 14 | 1 | 5 | 0.1 | | 1-Ru | 15 | 14 | 14 | | | ok | 286-cw |
| 117 | 46.9 | 32 | 14 | 1 | 5 | 0.1 | | 1-Pt | 15 | 9 | 20 | | | ok | 295-cw |
| 118 | 46.9 | 32 | 14 | 1 | 5 | 0.1 | | .2-Zr | 15 | 8 | 10 | 100 | 300 | ok | 275-cw |
| 119 | 47.4 | 32 | 14 | 1 | 5 | 0.1 | | .5-Si | 15 | | | | | fail | |
| 120 | 46.9 | 32 | 14 | 1 | 5 | 0.1 | | 1-Zr | 15 | 22 | 62 | 100 | 60 | ok | 308 |
| 121 | 47.8 | 32 | 14 | 1 | 5 | 0.2 | 0.07 | | 15 | 10 | 14 | 100 | 110 | ok | 298 |
| 122 | 45.9 | 32 | 14 | 1 | 5 | 0.1 | | 2-Ru | 14 | 8 | 15 | 220 | 120 | ok | 284 |

-continued

| | Composition | | | | | | | | | Contact resistance (milli ohms) | | | | | Hardness |
|---|---|---|---|---|---|---|---|---|---|---|---|---|---|---|---|
| | | | | | | B | | | Mod- | | | | | | ht unless |
| | | | | | | put | | | ulus | 150 C. Oxidation | | Sulfide Tarnish | | Pro- | marked |
| Alloy | Ag | Pd | Cu | Zn | Ni | up | recovery | Other | $10^6$ psi | 1000 hr | 2000 hr | 10 days | 30 days | cess | as CW |
| 123 | 47.8 | 32 | 14 | 1 | 5 | 0.2 | 0.07 | | 15 | 17 | 12 | 50 | 200 | ok | 319 |
| 124 | 47.7 | 32 | 14 | 1 | 5 | 0.3 | 0.15 | | 15 | 25 | 40 | 60 | 130 | ok | 324 |
| 125 | 47.6 | 32 | 14 | 1 | 5 | 0.4 | 0.185 | | 15 | | | | | fail | |
| 126 | 47.4 | 32 | 14 | 1 | 5 | 0.6 | 0.31 | | 15 | | | | | fail | |
| 127 | 46.8 | 32 | 14 | 1 | 5 | 0.2 | 0.05 | 1-Ru | 15 | 9 | 33 | 70 | 90 | ok | 318 |
| 128 | 47.3 | 32 | 14 | 1 | 5 | 0.2 | 0.065 | .5-Zr | 15 | 13 | 19 | 150 | 100 | ok | 331 |
| 129 | 46.6 | 32 | 14 | 1 | 5 | 0.4 | 0.19 | 1-Ru | 15 | | | | | fail | |
| 130 | 47.1 | 32 | 14 | 1 | 5 | 0.4 | 0.207 | .5-Zr | 15 | | | | | fail | |
| 131 | 47.64 | 32.23 | 14 | 1 | 5 | 0.2 | 0.07 | .05-Re | 15 | 18 | 18 | 55 | 60 | ok | |
| Ag | 100 | | | | | | | | 11 | | | 990 (2 days) | | ok | |
| S85 | 50.5 | 20.5 | 19.5 | 9.5 | | | | | 17 | 300 (700 hr) | | Open Cir | | ok | |
| S86 | 50.5 | 20.5 | 19.5 | | | | | 9.5-Fe | 14 | 55 (700 hr) | | Open Cir | | ok | |
| S87 | 50.5 | 20.5 | 19.5 | | | | | 9.5-Co | 14 | 20 (700 hr) | | 1500 | 13000 | ok | |

The test reported in the foregoing table indicates that nickel containing alloys will tarnish rapidly in the absence of zinc. However, a small addition of zinc produces some form of synergistic effect which greatly increases the tarnish resistance of the alloy as seen by comparing Alloy No. 78 which contains nickel only, Alloy 85 which contains zinc only, and Alloys 116– 130 which contain both zinc and nickel.

As can be seen from a number of the alloys, minor amounts of ruthenium, platinum and zirconium effect desirable improvements in the mechanical strength of the alloys, which allows the user to reduce the cross section required to carry specific design loads and thereby reduce costs and allow miniaturization of the contacts.

Thus, it can be seen from the foregoing detailed specification that the present invention provides a novel silver/palladium alloy for electronic applications which exhibits good electrical properties and desirable oxidation resistance and tarnish resistance. The alloy can be formed relatively easily into wrought metal sheet and strip for contact and other electronic applications.

Having thus described the invention, what is claimed is:

1. A silver/palladium alloy for electronic applications consisting essentially of:

(a) 35–60 percent by weight silver;

(b) 20–44 percent by weight palladium;

(c) 5–20 percent by weight copper;

(d) 1–7 percent by weight nickel;

(e) 0.1–5 percent by weight zinc;

(f) 0.06 to 0.18 percent by weight boron;

(g) up to 0.05 percent by weight rhenium; and (h) up to 1 percent by weight of modifying elements selected from the group consisting of ruthenium, zirconium and platinum, said alloy exhibiting high oxidation and tarnish resistance.

2. The silver/palladium alloy in accordance with claim 1 wherein silver comprises 45–50 percent by weight and palladium comprises 30–35 percent by weight.

3. The silver/palladium alloy in accordance with claim 2 wherein copper comprises 12–16 percent by weight and nickel comprises 4–6 percent by weight.

4. The silver/palladium alloy in accordance with claim 1 wherein said alloy contains 0.06–0.12 percent by weight boron.

5. The silver/palladium alloy in accordance with claim 1 wherein said alloy contains 0.02–0.1 percent by weight rhenium.

6. A silver/palladium alloy for electronic applications consisting essentially of:

(a) 35–60 percent by weight silver;

(b) 20–44 percent by weight palladium;

(c) 5–20 percent by weight copper;

(d) 1–7 percent by weight nickel;

(e) 0.1–5 percent by weight zinc;

(f) 0.06–0.12 percent by weight boron;

(g) up to 0.02–0.1 percent by weight rhenium; and (h) up to 1 percent by weight of modifying elements selected from the group consisting of ruthenium, zirconium and platinum, said alloy exhibiting high oxidation and tarnish resistance.

7. The silver/palladium alloy in accordance with claim 6 wherein silver comprises 45–50 percent by weight and palladium comprises 30–35 percent by weight.

8. The silver/palladium alloy in accordance with claim 6 wherein copper comprises 12–16 percent by weight and nickel comprises 4–6 percent by weight.

9. A wrought metal electronic component formed from a silver/palladium alloy consisting essentially:

(a) 35–60 percent by weight silver;

(b) 20–44 percent by weight palladium;

(c) 5–20 percent by weight copper;

(d) 1–7 percent by weight nickel;

(e) 0.1–5 percent by weight zinc;

(f) 0.06 to 0.18 percent by weight boron;

(g) up to 0.05 percent by weight rhenium; and (h) up to 1 percent by weight of modifying elements selected from the group consisting of ruthenium, zirconium and platinum.

10. The wrought metal electronic component in accordance with claim 9 wherein said component exhibits high oxidation and tarnish resistance.

11. The wrought metal electronic component in accordance with claim 10 wherein said contact resistance is less than 50 milliohms after 1000 hours exposure to air at 150° C.

12. The wrought metal electronic component in accordance with claim 10 wherein said contact resistance is less than 250 milliohms after 30 days exposure to a humid sulfurous atmosphere at 50° C.

13. The wrought metal electronic component in accordance with claim 9 wherein said component exhibits a modulus of at least $15\times10^6$ p.s.i..

* * * * *

UNITED STATES PATENT AND TRADEMARK OFFICE

CERTIFICATE OF CORRECTION

PATENT NO.: 5,484,569

DATED: January 16, 1996

INVENTOR(S): Arthur S. Klein and Edward F. Smith, III

It is certified that an error appears in the above-identified patent and that said Letters Patent is hereby corrected as shown below:

Column 2, line 37, after "of", delete "0.1-7 percent", and insert --1-7 percent--.

Signed and Sealed this

Twenty-eighth Day of July, 1998

*Attest:*

Bruce Lehman

BRUCE LEHMAN

*Attesting Officer*

*Commissioner of Patents and Trademarks*